US006579417B1

(12) United States Patent
Hund et al.

(10) Patent No.: US 6,579,417 B1
(45) Date of Patent: Jun. 17, 2003

(54) FLOCCULATION METHOD FOR MAKING A PAPER SHEET

(75) Inventors: Rene Hund, Villars (FR); Christian Jehn-Rendu, Saint Etienne Cedex (FR)

(73) Assignee: SNF S.A., Saint-Etienne Cedex (FR)

( * ) Notice: Subject to any disclaimer, the term of this patent is extended or adjusted under 35 U.S.C. 154(b) by 0 days.

(21) Appl. No.: 09/700,719

(22) PCT Filed: May 21, 1999

(86) PCT No.: PCT/FR99/01209

§ 371 (c)(1),
(2), (4) Date: Mar. 9, 2001

(87) PCT Pub. No.: WO99/61702

PCT Pub. Date: Dec. 2, 1999

(30) Foreign Application Priority Data

May 28, 1998 (FR) ..... 98 06876

(51) Int. Cl.[7] ..... D21H 21/10

(52) U.S. Cl. ..... 162/164.1; 162/168.1; 162/168.2; 162/168.3; 162/164.5; 162/183

(58) Field of Search ..... 162/183, 168.2, 162/168.3, 164.1, 168.1, 164.5

(56) References Cited

U.S. PATENT DOCUMENTS

| | | | | | |
|---|---|---|---|---|---|
| 4,759,856 | A | * | 7/1988 | Farrar et al. | 162/168.2 |
| 5,180,473 | A | * | 1/1993 | Akune et al. | 162/168.2 |
| 5,254,221 | A | * | 10/1993 | Lowry et al. | 162/168.2 |
| 5,431,783 | A | * | 7/1995 | Honig | 162/168.2 |
| 5,571,380 | A | | 11/1996 | Fallon | |
| 5,630,907 | A | | 5/1997 | Nilz et al. | |

FOREIGN PATENT DOCUMENTS

| | | |
|---|---|---|
| DE | 44 06 624 A | 9/1995 |
| EP | 0 201 237 A | 11/1986 |

* cited by examiner

*Primary Examiner*—Peter Chin
(74) *Attorney, Agent, or Firm*—Bacon & Thomas

(57) ABSTRACT

According to the present invention, a cross-linked polymer or copolymer formed by reverse phase emulsion polymerization from suitable water-soluble monomers or from mixtures of such monomers is used as a retention agent.

The process according to the invention is characterized in that the cross-linked polymer is sheared before its introduction or injection into the suspension to be flocculated.

This results in a distinct improvement in the retention, formation, drainage and other properties of the paper or paperboard sheet thus obtained, as a function of the shearing.

19 Claims, 8 Drawing Sheets

FLOCCULATION METHOD FOR MAKING A PAPER SHEET

The present invention relates to the field of synthetic polymers obtained from water-soluble monomers, or from mixtures of such monomers, and their specific application to the manufacture of a sheet of paper, paperboard or the like.

These polymers were introduced as flocculating agents some forty years ago, with molecular weights which at that time were relatively low. U.S. Pat. No. 3,325,490 (Goren) describes various gel polymers.

It is possible to use some of the Goren polymers as coagulating agents, particularly for coagulating very fine solid matter in suspension.

Modern flocculating agents have been researched in industry for at least two decades, for example those for the flocculation of solid matter in suspension in the field of water treatment, and especially in municipal sewage treatment, which are linear polymers of very high molecular weight. U.S. Pat. No. 3,557,061 may be cited as an example in this field.

European patent 0 201 237 describes a flocculation process in which a polymer material is added to water to form an aqueous composition, and is used to flocculate the solid matter in suspension in an aqueous suspension, this polymer comprising a polymer of high molecular weight that is subjected to a shearing, this shearing being carried out before or during the flocculation and the polymer being required to have certain intrinsic properties, which are indicated in this patent.

According to this document, the polymer is a polymer of high molecular weight, formed from water-soluble monomers or from a mixture of such monomers, and the polymer is subjected to shearing. The process described in this patent is characterized in that it is possible to carry out the shearing before or during the flocculation. European patent 0 201 237 further indicates that the polymer used comprises a cross-linked water-swellable polymer which it is possible to shear to an intrinsic viscosity of at least 4 dl/g. It is also indicated that the aqueous composition containing the polymer material can be a stable and homogenous composition, the shearing in this case causing an increase in the intrinsic viscosity of at least 1 dl/g.

In this document, "stable and homogenous" designates a polymer composition that is stable when the polymer is at full equilibrium with the water, i.e., when it has reached its ultimate degree of solubility or swelling. The composition is also homogeneous in the sense that the polymer remains uniformly dispersed throughout the composition, without having a tendency to precipitate after several days.

This document specifically describes a number of applications for water treatment, which is clearly precisely the main application intended, and coal ore treatment.

This patent also mentions, very briefly and without providing an exemplary embodiment or even any precise instructions for implementation, an application to paper or paperboard manufacturing; it merely indicates that the polymer can be added at an early stage of the pulp (fibrous mass) circulation line with a shearing along the flow line of the suspension, near the drainage stage or another water removal stage. The patent indicates that the shearing is carried out by pumping, hence by means of the "fan pump" or mixing pump effectively disposed in line in paper machines.

For the other applications, and especially for water treatment, the document also indicates that it is possible to carry out the shearing on the production line, as the suspension to be flocculated approaches a centrifuge, a filter press or a belt press, or another water removal stage. It is also indicated that the shearing can be carried out during a water removal stage that is conducted under a certain shear, preferably in a centrifuge or even in a filter press or a belt press.

Hence, this document only teaches a shearing of the flocs in the mixing pump or "fan pump" for the papermaking application. Moreover, it teaches that very low shear rates can be appropriate in the other applications, since filter presses and belt presses induce very low shear.

The present invention relates to a considerable improvement of this process and of the corresponding flocculating agents, with unexpected advantages in the application specific to the manufacture of a sheet of paper, paperboard or the like when operating under specific conditions, which are described below.

According to the present invention, the only flocculating agent used, which is intended to markedly improve the retention, formation, drainage and other properties of the paper or paperboard sheet thus obtained, is a cross-linked polymer or copolymer formed from suitable water-soluble monomers or mixtures of such monomers.

The process according to the invention is characterized in that the cross-linked polymer is sheared before introduction or injection into the suspension to be flocculated.

Therefore, there is no shearing of the suspension containing the polymer.

The monomers can be nonionic, but generally at least some of the monomers used to form the polymer are ionic. The monomers are usually monomers with monoethylenic unsaturation, sometimes allylic monomers, but generally vinyl monomers. These are generally acrylic or metacrylic monomers.

Suitable nonionic monomers are acrylamide, metacrylamide, N-vinyl methyl acetamide or N-vinylformamide, vinyl acetate, vinylpyrrolidone, methyl methacrylate or other methacrylates of acrylic esters, or of other esters with ethylenic unsaturation, or of other vinyl monomers that are insoluble in water such as styrene or acrylonitrile.

Suitable anionic monomers are for example sodium acrylate, sodium methacrylate, sodium itaconate, 2-acrylamido-2-methylpropane sulfonate (AMPS), the sulfopropylacrylates or sulfopropylmethacrylates, or other water-soluble forms of these polymerizable sulfonic or carboxylic acids. It is possible to use a sodium vinylsulfonate or an allylsulfonate, or a sulfomethyl acrylamide.

Suitable cationic monomers are the dialkylaminoalkyl acrylates and methacrylates, particularly dialkylaminoethyl acrylate, as well as their salts acidified or quaternized by means known to one skilled in the art, such as benzyl chloride, methyl chloride, aryl chloride, alkyl chloride, dimethyl sulfate, and even the dialkylaminoalkylalkylacrylamides or -methacrylamides, as well as their salts acidified or quaternized in a known way, for example methacrylamidopropyltrimethylammonium chloride (MAPTAC) and the Mannich products such as the quaternized dialkylaminomethylacrylamides. The alkyl groups in question are generally $C_1$–$C_4$ alkyl groups.

The monomers can contain hydrophobic groups, for example as described in European patent 0 172 723, and in certain cases allylic ether monomers could be preferred.

The cross-linking can be carried out during or after the polymerization, for example by reaction of two soluble polymers having counter-ions, or by reaction on formaldehyde or a polyvalent metal compound. Often the cross-linking is carried out during the polymerization by addition of a cross-linking agent, arid this method is clearly preferred according to the invention. These processes for polymerization with cross-linking are known.

The cross-linking agents that can be incorporated include ionic cross-linking agents such as polyvalent metal salts, formaldehyde, glyoxal, or preferably, covalent cross-linking agents that will copolymerize with the monomers, preferably monomers with diethylenic unsaturation (like the family of diacrylate esters such as the diacrylates of polyethylene glycol PEG) or polyethylenic unsaturation, of the type classically used for the cross-linking of water-soluble polymers, and particularly methylenebisacrylamide (MBA), or any of the other known acrylic cross-linking agents.

The quantity of cross-linking agents, and particularly of methylenebisacrylamide (MBA), that can be incorporated according to the invention is generally on the order of 5 to 100 ppm, preferably 5 to 40 ppm, and according to the best method, around 20 ppm of cross-linking agent/active material (polymer).

For details of the above, please refer to the content of European patent 0 201 237, which is incorporated herein by reference.

The polymers that are usable according to the invention can be prepared by a low concentration aqueous solution polymerization method, but the invention primarily relates to a reverse phase emulsion polymerization, that is, a water-in-oil emulsion polymerization.

Also known in the prior art are systems of retention agents for the manufacture of a sheet of paper, paperboard or the like, which comprise a combination of two retention agents, generally a main retention agent and a secondary retention agent. These are called "dual" systems.

Thus, in U.S. Pat. No. 4,753,710, it is recommended to use a linear acrylic polymer of high molecular weight as the main retention agent, which is added to the fibrous mass, followed by an intense shearing, particularly in the mixing pump or "fan pump," then an addition of bentonite (which is a swelling clay) as the secondary retention agent. This document neither suggests nor describes any shearing of the polymer itself before introduction into the suspension to be flocculated.

Also known in the prior art are cross-linked flocculating agents as described, for example, in European patent 0 202 780, primarily for the treatment of water, and secondarily for paper. It is important to note that it uses a cross-linked product which is added to the suspension to be flocculated, the flocs then being sheared during the paper manufacturing process, i.e., sheared in and at the same time as the paper pulp. The flocs are then transformed into flocs that are smaller and more shear resistant, therefore more tenacious. This document neither suggests nor describes any shearing of the polymer itself before introduction into the suspension to be flocculated.

Thus, according to the techniques of the prior art relative to papermaking applications, between the flocculating agent and the fibrous mass of pulp, flocs of fairly large size are formed, and are then sheared so as to form flocs which, in the documents cited, are said to be smaller and more tenacious.

Moreover, the systems of the prior art of the dual system type require the use of two retention components, and specifically the use of bentonite, which is a difficult product to use in industry, if only due to the environmental problems it causes. This bentonite is necessary to induce the reassembly of the sheared flocs, otherwise the latter will not stick to the drainage wire of the paper. Systems of this type can be classified as "microparticulate," and they comprise at least two retention agents.

The "dual" systems of the prior art were essentially composed of linear polymers with an addition of bentonite, or of a branched polyacrylamide or a starch, with an addition of colloidal silica, this last component being extremely expensive.

A known improvement of these processes is described in French patent 95 13 051 in the name of the Applicant, which relates to a dual system based on a polymer of the linear or branched polyacrylamide type and kaolin, kaolin being a non-swelling clay that does not have the drawbacks of bentonite, the kaolin being pre-treated in a preferred embodiment.

On the other hand, according to the present invention, only one retention agent is used, preferably in the form of a cross-linked reverse phase water-in-oil emulsion sheared before its injection, which leads directly to microflocs without going through the shearing of larger flocs involving the fibrous mass.

According to the invention, and without intending to be limited by any one theory, the Applicant in effect maintains that a microflocculation occurs directly as a result of the intense shearing carried out on the polymer itself before its injection into the fibrous mass of pulp, which is quite a different (and unexpected) process than reducing the size of large flocs (involving the fibrous mass) into smaller, more tenacious flocs, and which results in unforeseen improvements in the properties of the paper or paperboard sheet.

According to the invention, this "microflocculation" also avoids the presence of bentonite or another second "dual" retention agent.

According to the invention, the notable constraints and problems linked to the control and optimization of the flocculation parameters of a dual system, including the precise choice of the respective introduction points of the two reagents, are also avoided.

Reverse phase emulsion polymerization is quite well known to one skilled in the art.

It is noted that, contrary to certain aspects of the teaching of European patent 0 201 237, a shearing under the flow line conditions described in this document with a brief reference to paper manufacturing, page 6, lines 3–4, absolutely does not lead to the results of the invention.

For example, a shearing in a pump of the "fan pump" type does not produce the anticipated result. Specifically, and again in reference to an extremely brief mention of "paper and paperboard production," the introduction according to European patent 0 201 237 of the retention agent along the "flow line" of the process, near a drainage stage or another water removal stage, absolutely does not work.

On the other hand, it has been discovered according to the invention that, for the application related to the manufacture of a sheet of paper, paperboard or the like, it is essential to carry out an intense shearing before the injection of the cross-linked polymer into the paper pulp or fibrous mass prior to being flocculated.

The cross-linked polymer, pre-sheared according to the invention, is injected or introduced into the paper pulp (or fibrous mass to be flocculated), which is more or less diluted in accordance with the experience of one skilled in the art, and generally into the diluted paper pulp or "thin stock," i.e., a pulp diluted to about 0.7%–1.5% solid matter such as cellulose fibers, possible fillers, and various additives commonly used in paper manufacturing.

According to a variant of the invention with a fractionated introduction, some of the cross-linked polymer, sheared according to the invention, is introduced at the level of the stage for preparing the "thick stock" with about 5% or more solid matter, or even at the level of the preparation of the thick stock.

According to a variant of the invention, it is possible to use a reverse phase emulsion of the polymer, or even the powder obtained from the emulsion by means of a known drying technique such as, for example, "spray-drying," solvent precipitation, or agglomeration (PEG) and grinding, (on this subject, see also the prior art, such as U.S. Pat. No. 5,696,228, WO 97/48 755 (U.S. Ser. No. 08/668,288) WO 97/48 750, WO 97/48 732, WO 97/34 945, WO 96/10589, U.S. Pat. Nos. 5,346,986, 5,684,107, EP 0 412 388, EP 0 238 050, U.S. Pat. No. 4,873,299, EP 0 742 231, WO 90/08789 or EP 0 224 923) which is redissolved in water, sheared, then used like an emulsion.

This variant is quite advantageous since the dried product according to the invention behaves substantially like the emulsion, and this variant therefore provides a method for using dry products having the advantages of an emulsion, which it is not always possible to prepare by direct polymerization in the aqueous phase, in gel form or in solution.

According to the invention, it is preferable to use the reverse phase emulsion of the cross-linked polymer, or even the cross-linked polymer in solution as obtained through the redissolution of a powder as described above, with shearing prior to the injection into the pulp, of course.

Given below is a comparative example which shows that if the shearing of the fibrous mass is carried out (i.e., after the addition of the polymer) in a paper application, no retention is obtained. Without intending to be limited by any one theory, the Applicant maintains that this is due to the fact that the cationic charge is not released.

According to the invention, laboratory shearing tests can be conducted, with a concentration on the order of 3–5 to 10–15 g of active material (i.e., the polymer) per liter, preferably between 5 and 10 g/l, in a piece of equipment known as an "Ultra Turrax" (TM), for example at 10,000 rpm or in a household mixer of the "Moulinex" (TM) type, substantially at the same magnitude of rotation speed, for a duration that can last between 15–30 seconds and 2–5 minutes.

In the industry, there is existing equipment suitable for implementing the invention, for example high-pressure pumps or turbines, which are not referred to by the theoretical example of the document EP 0 201 237.

One skilled in the art will naturally know all the equipment that makes it possible to carry out an intense shearing on the polymer emulsion, diluted to an appropriate value as described below, without being limited to the above examples.

For the generalities of the production of a pulp for paper, paperboard or the like, as well as a list of the additives, fillers, etc., that are well known, it would be useful for one skilled in the art to refer to U.S. Pat. No. 4,753,710, whose teaching is incorporated herein by reference.

A normal dosage of the agent according to the invention is such that it results in about 100 to 500 g of active material (polymer) per ton of fibrous matter to be processed.

According to the invention, it is possible to use a polymer having an intrinsic viscosity i.v. as low as 1 to 3, which becomes an intrinsic viscosity as high as 3–7 or 8 after the application of the shear.

According to the invention, using an optimization within the scope of one skilled in the art, an ion regain (IR as defined in European patent 0 201 237) of 40 to 50% is obtained, which can reach at least 60 or 70%, and even more, up to values greater or far greater than 100%.

Moreover, it is possible to adjust the shearing so as to favor, for the first time in this industry, one property of the paper over another, for example to promote retention slightly more than formation or drainage, or vice versa, or any of the various possible combinations, as will be seen by reading the examples that follow.

Moreover, the system according to the invention is not expensive, and consequently it combines all of the advantages of the linear or cross-linked single-product systems with floc shearing and of the "dual" systems with two retention agents and also with floc shearing.

The following examples illustrate the invention without limiting its scope.

The examples of the production of the polymer are followed by a Table ("Example 1, 2 or 3") indicating the properties of the polymer obtained, and by a two-part Table (numbered No. 1, No. 2 and No. 3 with reference to the product in the preceding tables) indicating in one part the applicable test conditions and in the other part the results relative to retention, drainage and formation, and other analogous properties.

These two-part tables make it possible to plot the drainage, retention or turbidity graphs that are appended in the form of FIGS. 1 through 8.

The abbreviations have the meanings indicated below.

RET=type of addition of the solution of the emulsion according to the invention, sheared before injection
DOS=dosage of the retention agent according to the invention, in % agent/dry pulp
TUR=turbidity
ChM=mineral filler %/dry pulp
Ash=weight of ash in grams and in %, respectively
MES=matter in suspension
GCC=ground Ca $CO_3$
CSF=CSF drainage
GB0=basis weight 80 g
UX=shearing time in the "Ultra Turrax" (TM), in seconds
Pds=weight of the sheet, in grams
X designates a "first pass" measurement

EXAMPLE 1

Production of a Cross-linked Ethyl Acrylate Trimethyl Ammonium Chloride-based Polymer in the Form of an Emulsion of the EM 240 BD Type In a reactor A, the constituents of the organic phase of the emulsion to be synthesized are mixed at the ambient temperature.

a) Organic phase:
- 266 g of Exxsol D100
- 18 g of Span 80
- 6 g of Hypermer 2296.

b) In a beaker B, the phase of the emulsion to be produced is prepared by mixing:
- 438 g of acrylamide at 50%
- 186.5 g of ethyl acrylate trimethyl ammonium chloride (80%)
- 85 g of water
- 0.31 ml of methylenebisacrylamide at 6 g/l
- 1.50 ml of sodium bromate at 50 g/l
- 0.24 ml of Versenex at 200 g/l
- pH: 4

The contents of B are mixed into A under agitation. After the mixing of the phases, the emulsion is sheared in the mixer for 1 minute in order to create the reverse phase emulsion. The emulsion is then degassed by means of a nitrogen bubbling; then, after 20 minutes, the gradual addition of the metabisulfite causes the initiation followed by the polymerization.

Once the reaction is finished, a burn out is performed in order to reduce the free monomer content.

The emulsion is then incorporated with its inverting surfactant in order to subsequently release the polymer in the aqueous phase.

Table of Example 1:

| Test | CAT % | MBA ppm | UL Viscosity | IR (%) | IVR (%) | State |
|---|---|---|---|---|---|---|
| EM 240 CT | 20 | 5 | 4.5 | 0 | 0 | Linear |
| EM 240 BD | 20 | 5 | 1.85 | 60 | 65 | Cross-linked |

Note: example with 20 mole % acrylate
(1) ion regain, %
(2) intrinsic viscosity regain, %
CAT = cationicity of the polymer, %
MBA = methylenebisacrylamide, cross-linking agent Definitions of the Ion Regains and Intrinsic Viscosity Regains Ion regain IR = (X−Y)/Y × 100 with X : ionicity after shearing in meq/g.
Y : ionicity before shearing in meq/g.

Intrinsic viscosity regain IVR = (V1−V2)/V2 × 100 with V1 : intrinsic viscosity after shearing in dl/g
V2 : intrinsic viscosity before shearing in dl/g Procedure for Testing the Emulsions

| Pulp used: | |
|---|---|
| mixture of 70% bleached hardwood kraft | KF |
| 10% bleached softwood kraft | KR |
| 20% mechanical pulp | PM |
| 20% natural calcium carbonate GCC = ground $CaCO_3$ | |
| Sizing in neutral medium with 2% of an alkyl ketene dimer emulsion. | |

The pulp used is diluted to a consistency of 1.5%. A sample of 2.24 dry g of pulp, or 149 g of pulp at 15%, is taken, then diluted to 0.4% with clear water.

*G*=basis weight, ex. *G*80=basis weight of 80 g/m$^2$

The volume of 560 ml is introduced into the plexiglass cylinder of the automated sheet former and the sequence is started.

| | |
|---|---|
| t = 0 s, | start of agitation at 1500 rpm. |
| t = 10 s, | addition of the polymer. |
| t = 60 s, | automatic reduction to 1000 rpm and, if necessary, addition of bentonite. |
| t = 75 s, | stopping of the agitation, formation of the sheet with vacuum under the wire, followed by reclamation of the white water. |

The following operations are then carried out:

measurement of the turbidity of the water under the wire.

dilution of a beaker of thick stock for a new sheet with the reclaimed water under the wire.

drying of the so-called 1st pass sheet. ("X"=1st pass)

start of a new sequence for producing the so-called 2nd pass sheet.

After 3 passes, the products to be tested are changed. The following analyses are then performed:

measurement of the matter in suspension in the water under wire (TAPPI standard: T 656 cm/83))

measurement of the weight of the ash in the sheets (TAPPI standard: T 211 om—93)

measurement of the turbidity 30' after the fibers are deposited in order to learn the state of the ionic medium (MES=matter in suspension)

measurement of the degree of drainability of the pulp with a Canadian Standard Freeness (CSF; TAPPI standard T 227 om—94).

The results are presented in Table 1 and the figures defined below:

Comments on Example 1

Figure 1:
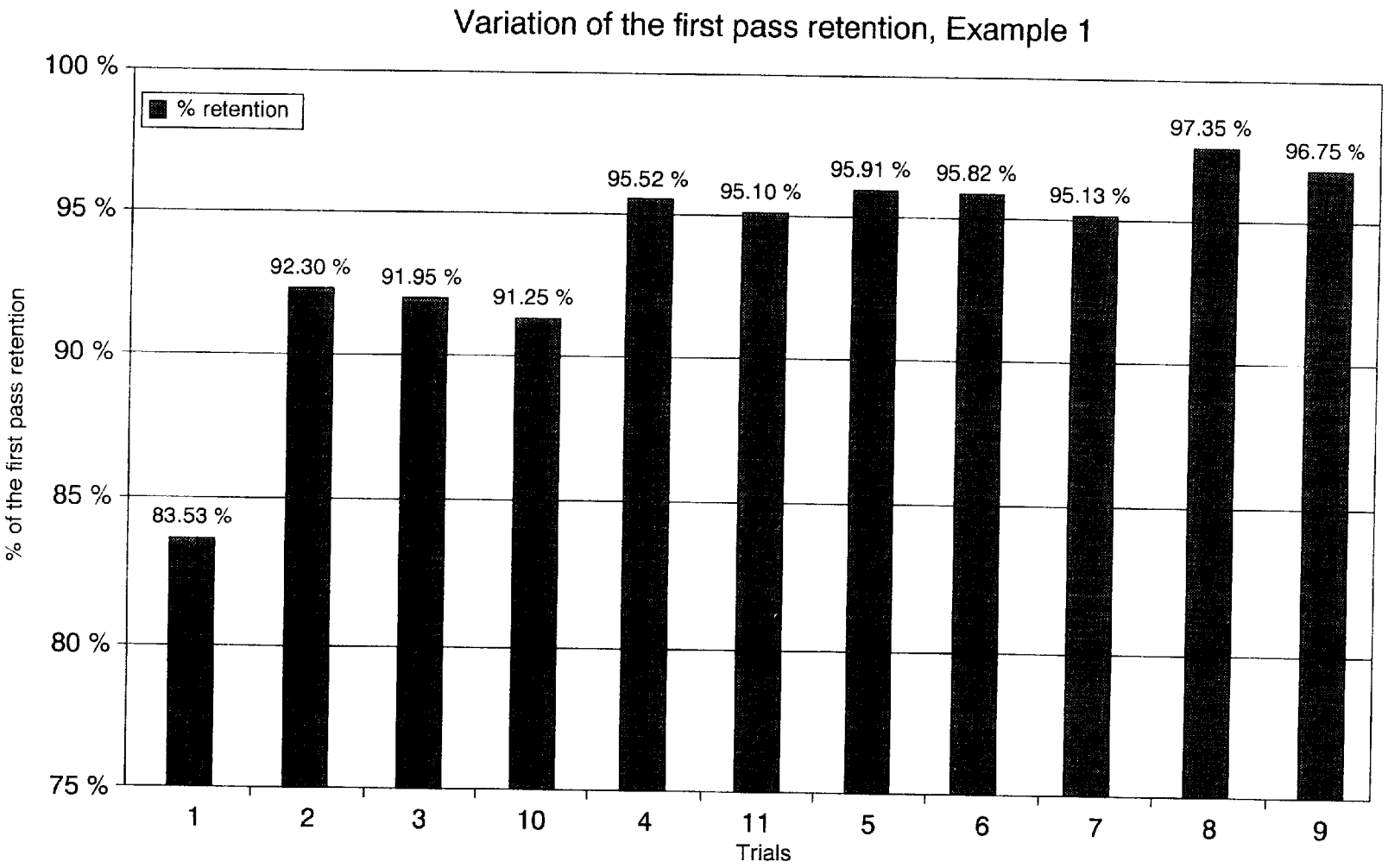
FIG. 1 represents the histogram of the first-pass retention figures corresponding to Table 1.
Figure 2:
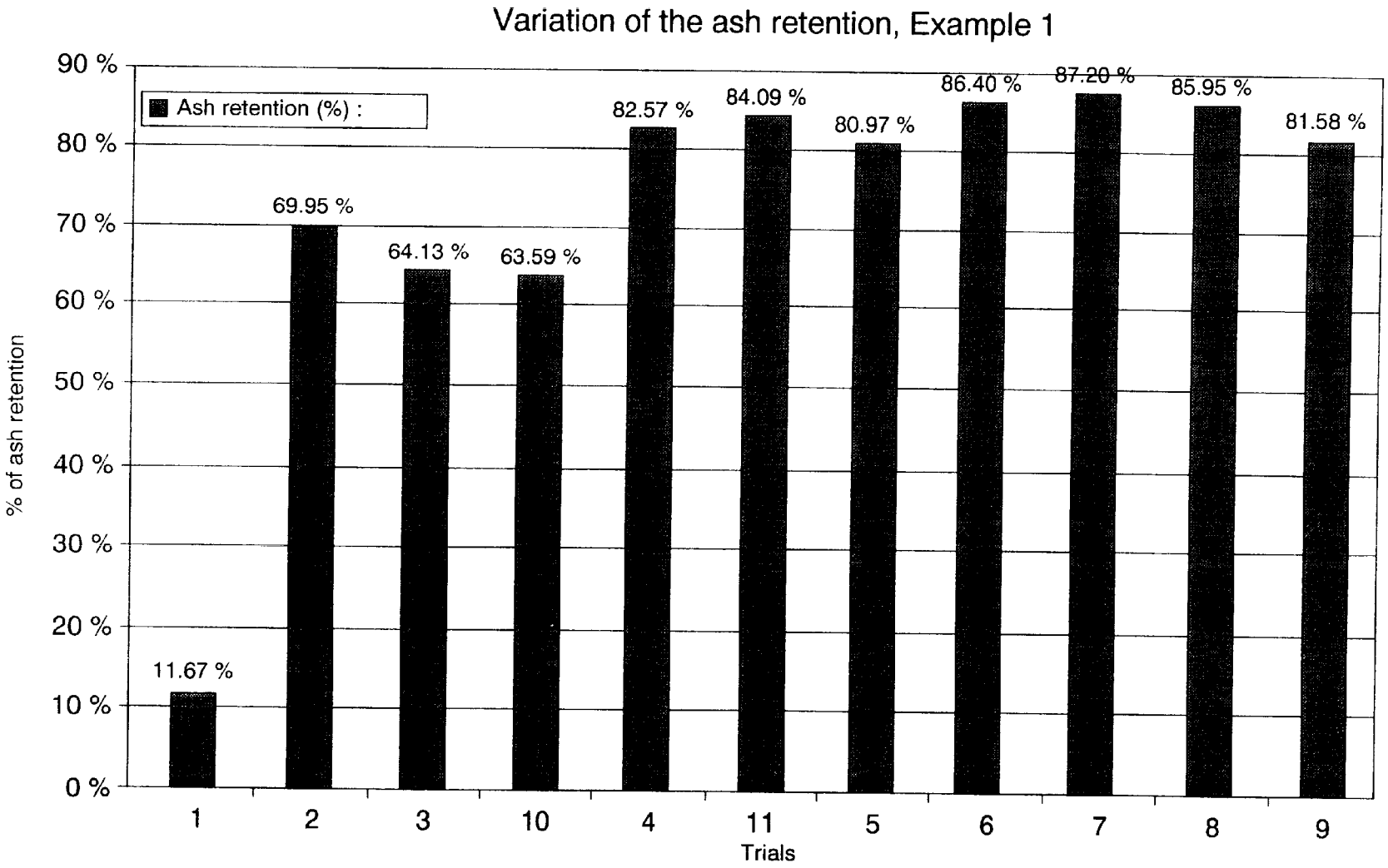
FIG. 2 represents the histogram of the ash retention figures corresponding to Table 1.
Figure 3:
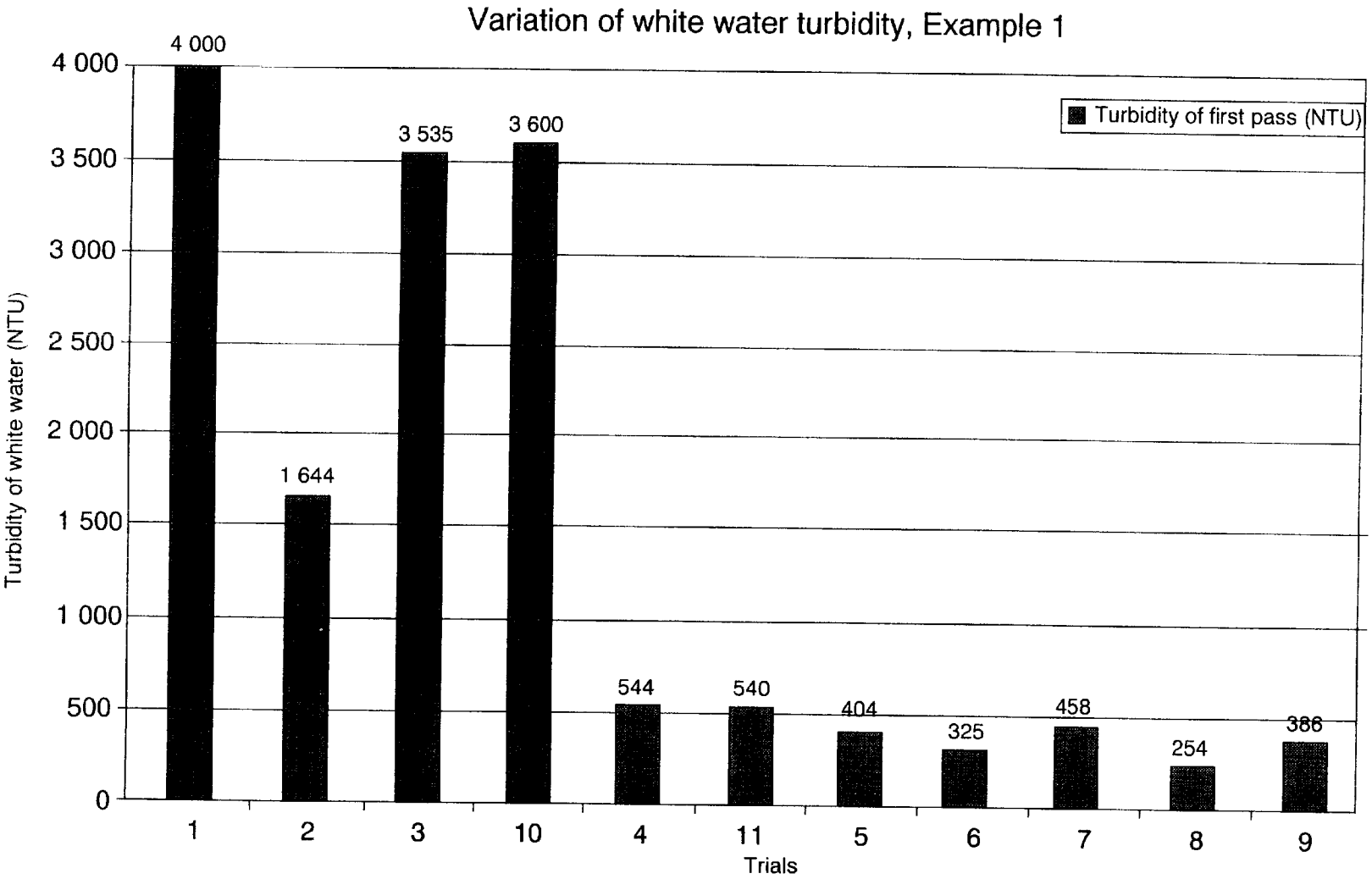
FIG. 3 represents the histogram of the white water turbidity figures corresponding to Table 1.
Figure 4:
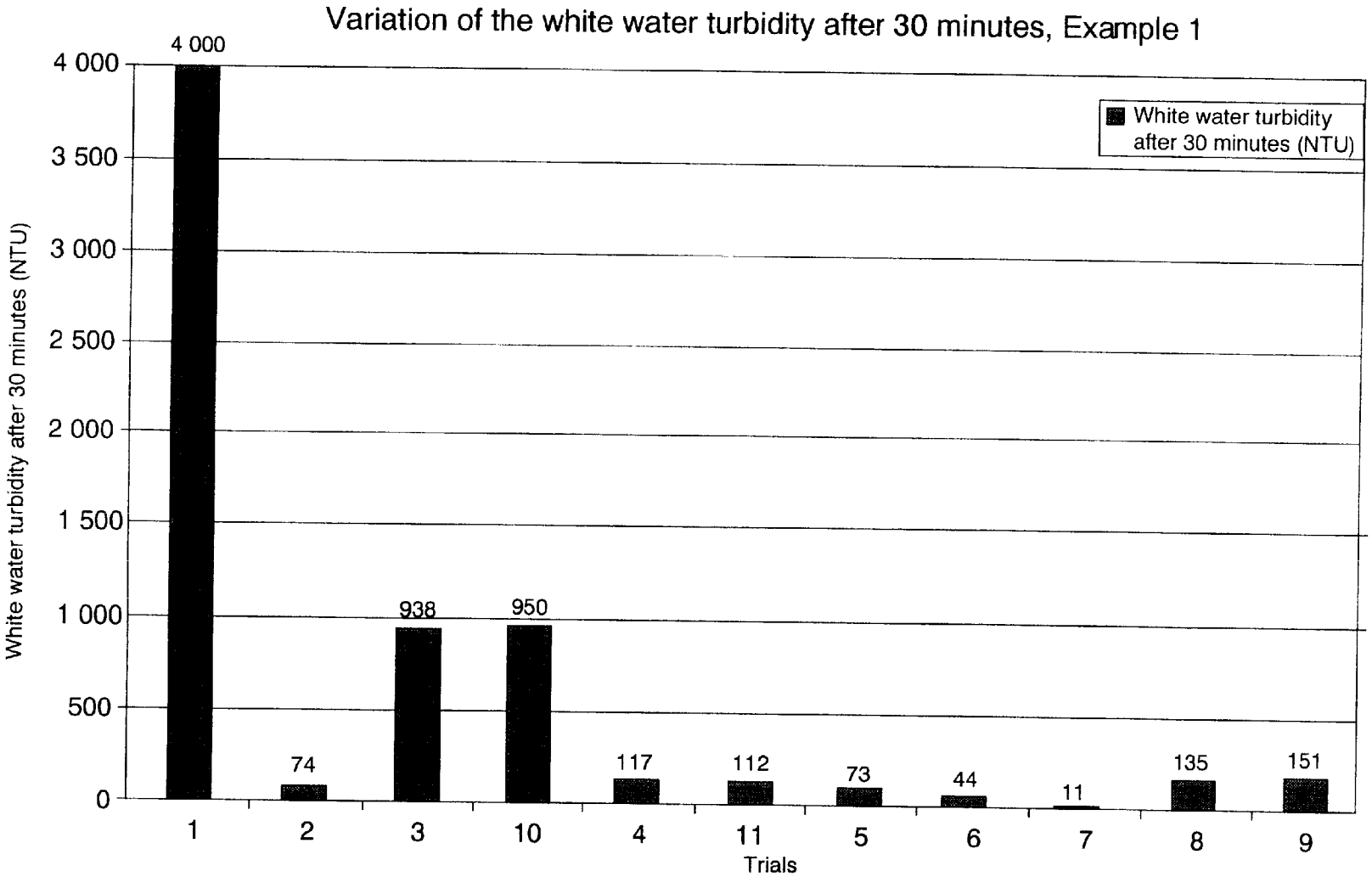
FIG. 4 represents the histogram of the white water turbidity figures after 30 minutes of rest corresponding to table 1.

As far as filler retention is concerned, the results show that there is little advantage to using a non-sheared cross-linked polymer emulsion (value 64.14%) at a dosage commonly used in the industry, of 500 g/l, as compared to a linear polyacrylamide emulsion (69.93%).

On the other hand, the advantage of shearing the cross-linked emulsion before its addition to the suspension or fibrous mass is quite clear and is surprising. In effect, this results in a 28% improvement in filler retention as compared to the product that is not sheared before introduction into the fibrous mass, and a 20% improvement as compared to a linear emulsion.

Likewise, the histograms related to the turbidity measurements of the water under the wire (white water reclaimed under the wire) surprisingly show that the turbidity is divided by a factor of three according to the invention.

The overall retention has the same tendency and therefore the same comments apply.

Variant According to the Invention (Overdosage, Approx. 1 kg/t)

It is also noted that the invention makes it possible to completely eliminate the operation for shearing the cross-linked polymer emulsion before introduction into the fibrous mass, provided that the polymer is overdosed. Surprisingly, without shearing, the effects of the sheared cross-linked emulsions are retained (by way of a non-limiting example, an overdosage to 1000 g/t, which is quite unusual in this industry). This choice can offer advantages in certain applications; for example the shearing time and the corresponding equipment, which are two important factors for the end user, are eliminated, and thus it is possible to increase drainage and hence productivity since it then becomes possible to increase the speed of the machine.

EXAMPLE 2

Production of an Ethyl Acrylate Trimethyl Ammonium Chloride-based Cross-linked Polymer in the Form of a Reverse Phase Water-in-oil Emulsion In a reactor A, the constituents of the organic phase of the emulsion to be synthesized are mixed at the ambient temperature.

a) Organic phase:

266 g of exxsol D 100

18 g of Span 80

6 g of Hypermer 2296.

b) In a beaker B, the phase of the emulsion to be produced is prepared by mixing:

565.7 g of acrylamide at 50%

107 g of ethyl acrylate trimethyl ammonium chloride (80%)

35.3 g of water 0.31 ml of methylenebisacrylamide at 6 g/l 1.50 ml of sodium bromate at 50 g/l 0.24 ml of Versenex at 200 g/l pH: 4

The contents of B are mixed into A under agitation. After the mixture of the phases, the emulsion is sheared in the mixer for 1 minute in order to create the reverse phase emulsion. The emulsion is then degassed by means of a nitrogen bubbling; then after 20 minutes, the gradual addition of the metabisulfite causes the initiation followed by the polymerization.

Once the reaction is finished, a "burn out" (bisulfite or metabilsulfite treatment) is performed in order to reduce the free monomer content.

The emulsion is then incorporated with its inverting surfactant in order to subsequently release the polymer in the aqueous phase.

Table of Example 2:

| Test | CAT % | MBA ppm | UL Viscosity | IR (1) (%) | IVR(2) (%) | State |
|---|---|---|---|---|---|---|
| 448 A | 10 | 5 | 2.05 | 55 | 60 | Cross-linked |
| 448 B | 10 | 10 | 1.68 | 80 | 80 | Cross-linked |
| 448 C | 10 | 15 | 1.49 | 100 | 85 | Cross-linked |
| EM 140 CT | 10 | 0 | 4.5 | 0 | <=0 | Linear |
| SD 448 B | 10 | 10 | 1.65 | 80 | 82 | Cross-linked |

Note: example with 10 mole % acrylate.
(1) ion regain, %
(2) intrinsic viscosity regain, %
CAT = cationicity of the polymer, %
MBA = methylenebisacrylamide, cross-linking agent The product SD 448 B is the product 448 B which has been dried by spray-drying, followed by a dissolution of the white powder obtained, a shearing of the solution at about 5–10 g/l, after which it is used like the emulsion 448 B.

Definitions of the Ion Regains and Intrinsic Viscosity Regains

Ion regain = (X–Y)/Y × 100 with X : ionicity after shearing in meq/g.
Y : ionicity before shearing in meq/g.

Intrinsic viscosity regain = (V1–V2)/V2 × 100

With V1 : intrinsic viscosity after shearing in dl/g
V2 : intrinsic viscosity before shearing in dl/g Procedure for Testing the Emulsions Pulp Used

| | |
|---|---|
| mixture of 70% bleached hardwood kraft | KF |
| 10% bleached softwood kraft | KR |
| 20% mechanical pulp | PM |
| 20% natural calcium carbonate | GCC = ground $CaCO_3$ |

Sizing in a neutral medium with 2% of an alkyl ketene dimer emulsion.

The pulp used is diluted to a consistency of 1.5%. A sample of 2.24 dry g of pulp, or 149 g of pulp at 15%, is taken, then diluted to 0.4% with clear water.

*G*=basis weight ex. *G*80=basis weight of 80 g

The volume of 560 ml is introduced into the plexiglass cylinder of the automated sheet former and the sequence is started:

t=0 s, start of agitation at 1500 rpm.

t=10 s, addition of the polymer.

t=60 s automatic reduction to 1000 rpm and, if necessary, addition of bentonite.

t=75 s, stopping of the agitation, formation of the sheet with vacuum under the wire, followed by reclamation of the white water.

The following operations are then carried out:

measurement of the turbidity of the water under wire.

dilution of a beaker of thick stock for a new sheet with the reclaimed water under the wire.

drying of the so-called 1st pass sheet. ("X"—1st pass)

start of a new sequence for producing the so-called 2nd pass sheet.

After 3 passes, the products to be tested are changed.

The following analyses are then performed:

measurement of the weight of the ash in the sheets (TAPPI standard: T 211 om—93)

measurement of the turbidity 30' after the fibers are deposited in order to learn the state of the ionic medium (MES=matter in suspension)

measurement of the degree of drainability of the pulp with a Canadian Standard Freeness (CSF; TAPPI standard T 227 om—94).

Figure 5:
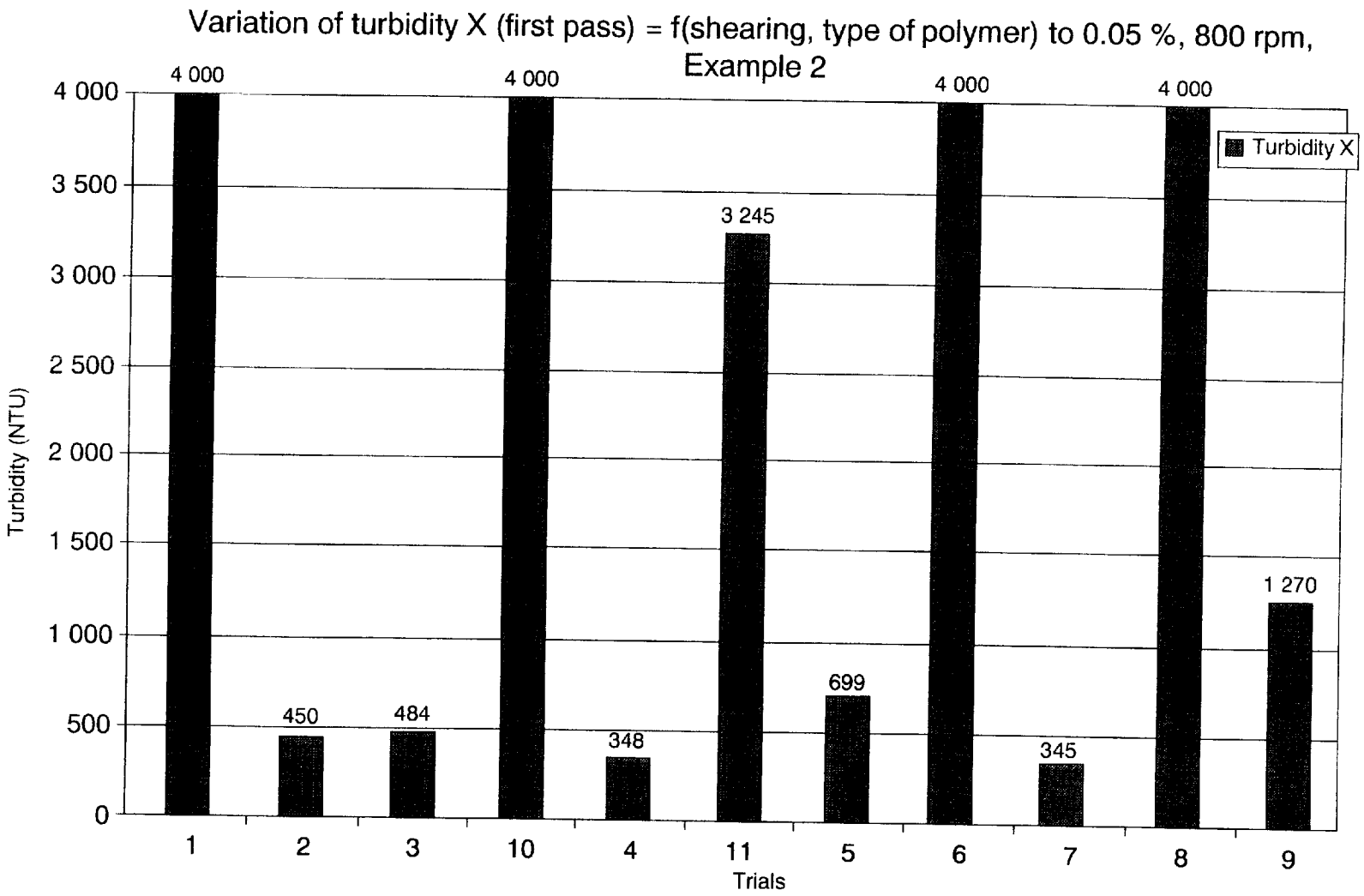
Figure 6:
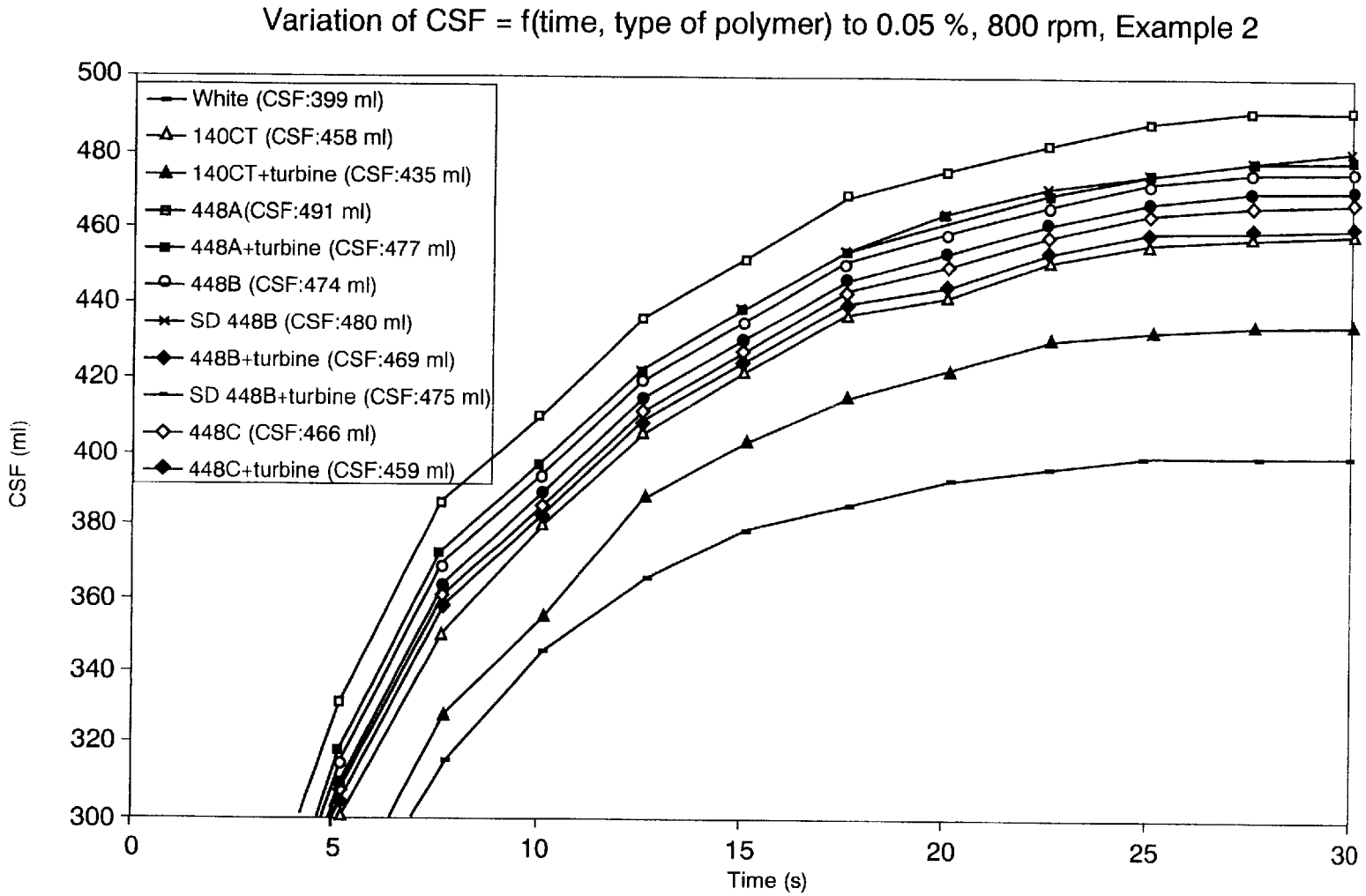

The results are presented in Table 2 and the figures below:

FIG. 5 represents the histogram of the white water turbidity figures corresponding to Table 2;

FIG. 6 represents the drainage curve corresponding to Table 2.

Comments on Example 2

The shearing applied to the standard linear retention agent (EM 140 CT) causes a reduction in drainage (–5%).

The products that are cross-linked but used without shearing produce better results than the linear emulsion (448 A: +7%)

A shearing applied to this same cross-linked product 448 A causes a +4% improvement in drainage as compared to the linear emulsion.

It is also noted that these improvements in drainage are surprisingly not detrimental to the filler retention.

On the other hand, and even more surprisingly, according to the invention there is a distinct improvement in the clarity of the white water, as evidenced by the 1st pass turbidity measurements (column X); the following examples in particular should be compared:

EM 140 CT turbidity TUR 450

448 A (cross-linked, sheared according to the invention) 348

Moreover, the invention provides another important advantage related to a very distinct improvement in the formation of the sheet. As is known, formation indicates the qualities of the sheet such as homogeneity and the like.

This advantage, in addition to the two mentioned above, can be attributed to the microflocculation induced by the agents sheared according to the invention.

EXAMPLE 3

The same polymer agent as in Example 2 is used, but at a different dosage (0.1% polymer relative to the fibrous mass to be flocculated).

Figure 7:
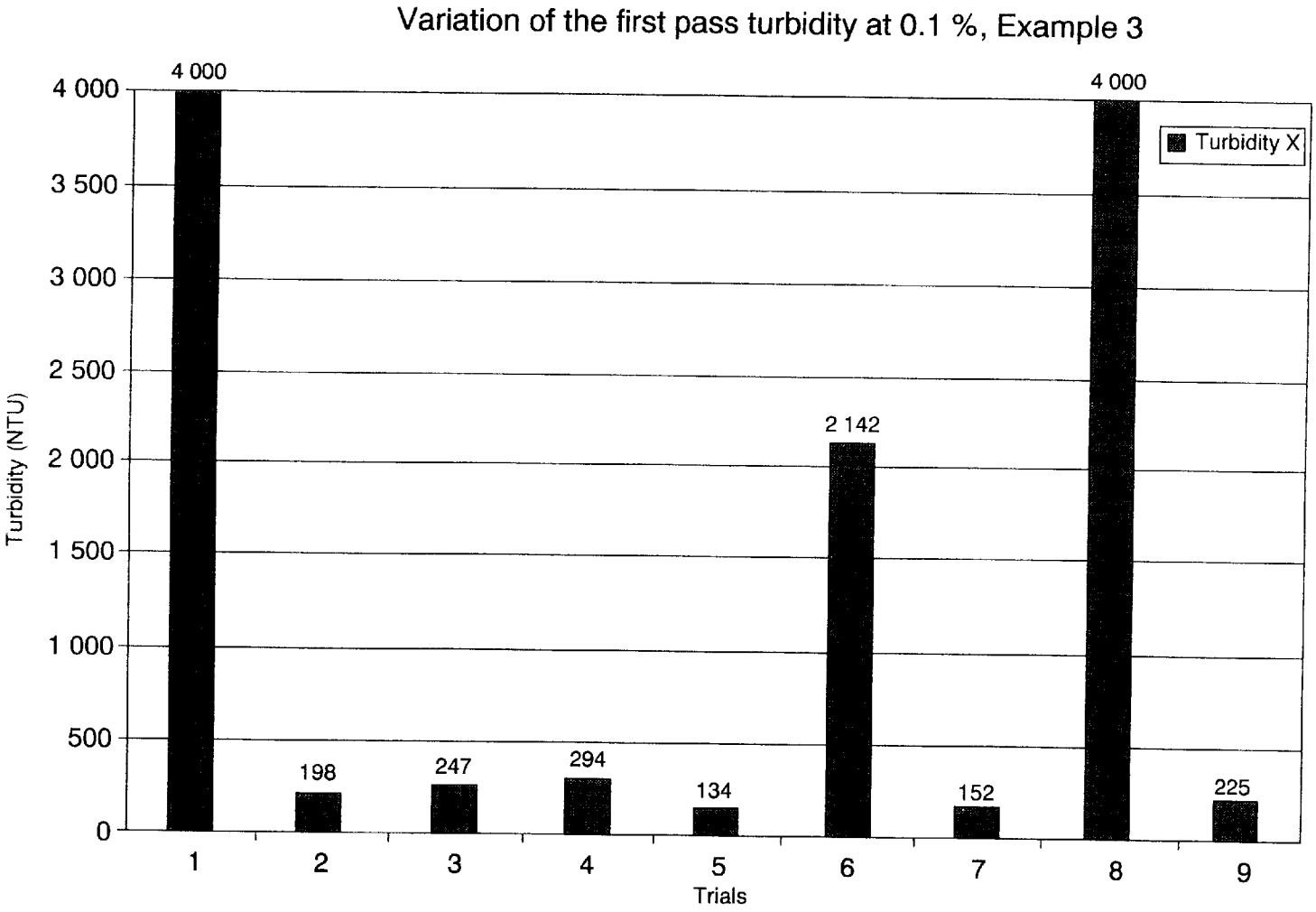
Figure 8:
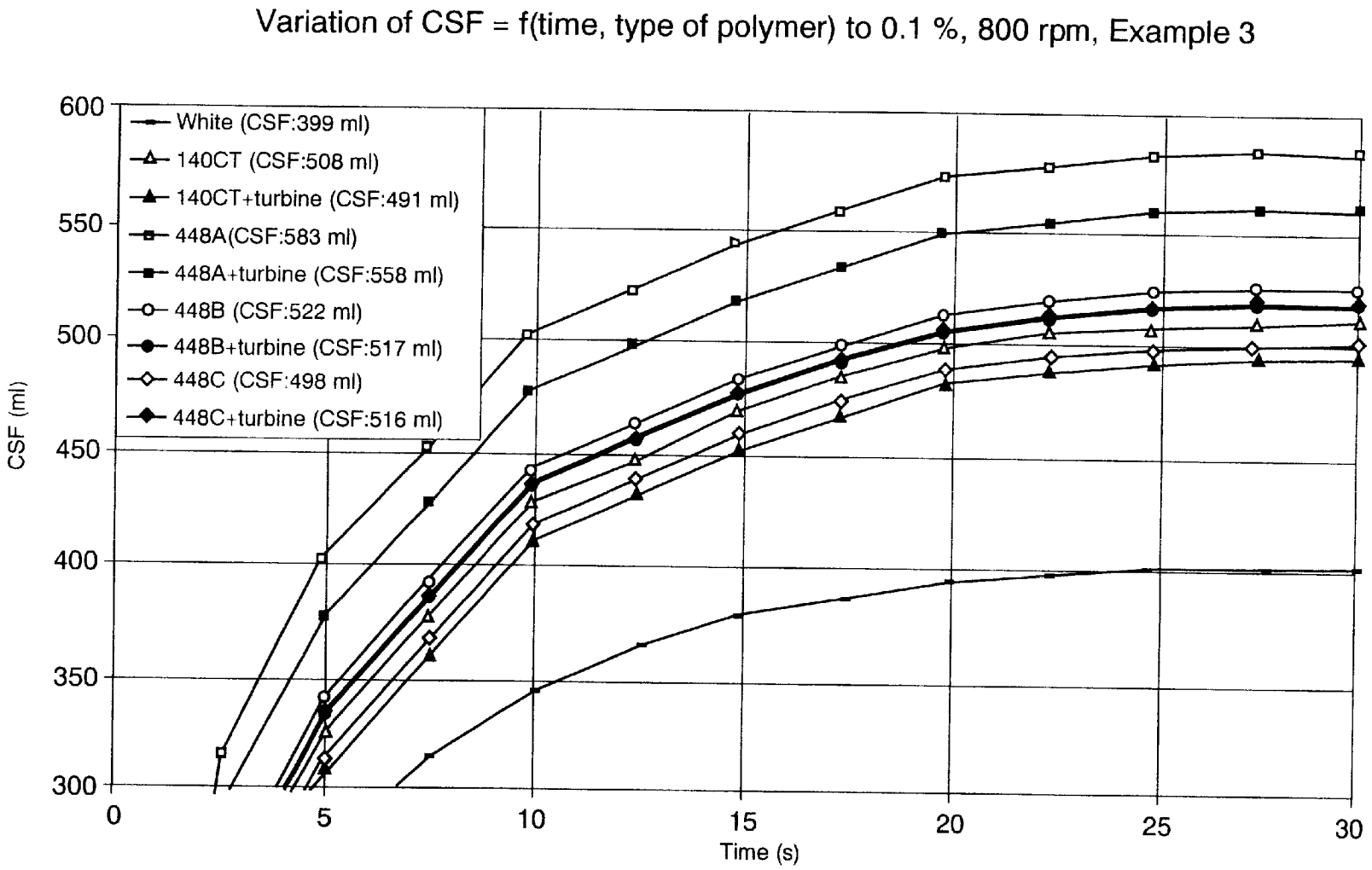

The results are presented in Table 3 and the figures below:

FIG. 7 represents the histogram of the white water turbidity figures corresponding to Table 3;

FIG. 8 represents the drainage curve corresponding to Table 3.

Comments on Example 3

This example shows the effects obtained with a high dosage of retention agent.

An obvious deterioration of the formation is observed in the case of an overdosage of a standard linear polymer of high molecular weight. On the other hand, no harmful effect is observed in the case of an overdosage of the products cross-linked and sheared before introduction, according to the invention.

When it comes to drainage and turbidity, the agents that are cross-linked and sheared before introduction into the fibrous mass retain their surprising advantages, described above.

TABLE N° 1

EXAMPLE 1

Type of pulp 70% KF, 10% KR, 20% PM, 20% GCC.
CSF 365 ml
Consistency (before dilution) 1.5%
Rotational speed 800/30 s
pH pulp 7.5
G80

| Trial | Shearing t = | RET 1 = 10 s | % | ChM (%) | TUR X | MES X | Pds X | % retent. X |
|---|---|---|---|---|---|---|---|---|
| 1 | | — | — | 20 | >4000 | 733.7 | 2.0831 | 83.53% |
| 2 | 0" | EM 240 CT | 0.05 | 20 | 1644 | 329.8 | 2.2135 | 92.30% |
| 3 | 0" | EM 240 BD | 0.05 | 20 | 3535 | 355.7 | 2.2757 | 91.95% |
| 4 | 30" | EM 240 BD | 0.05 | 20 | 544 | 203.7 | 2.4313 | 95.52% |
| 5 | 1' | EM 240 BD | 0.05 | 20 | 404 | 197.6 | 2.5917 | 95.91% |
| 6 | 3' | EM 240 BD | 0.05 | 20 | 325 | 193.6 | 2.4861 | 95.82% |
| 7 | 7'30" | EM 240 BD | 0.05 | 20 | 458 | 213.6 | 2.338 | 95.13% |
| 8 | 0" | EM 240 BD | 0.1 | 20 | 254 | 123.2 | 2.5361 | 97.36% |
| 9 | 0" | EM 240 CT | 0.1 | 20 | 386 | 146.1 | 2.4382 | 96.75% |
| 10 | 0 | SD 240 BD | 0.05 | 20 | 3600 | 355.4 | 2.2750 | 91.25% |
| 11 | 30 s | SD 240 BD | 0.05 | 20 | 540 | 212.5 | 2.4311 | 95.1% |

TABLE N° 1-continued

EXAMPLE 1

Type of pulp 70% KF, 10% KR, 20% PM, 20% GCC.
CSF 365 ml
Consistency (before dilution) 1.5%
Rotational speed 800/30 s
pH pulp 7.5
G80

| Trial | Shearing | RET | % | ChM (%) | Ash X | Ash X | Turb 30' X |
|---|---|---|---|---|---|---|---|
| 1 | | — | — | 20 | 0.0475 | 11.67% | >4000 |
| 2 | 0" | EM 240 CT | 0.05 | 20 | 0.27151 | 69.90% | 74 |
| 3 | 0" | EM 240 BD | 0.05 | 20 | 0.2587 | 64.13% | 938 |
| 4 | 30" | EM 240 BD | 0.05 | 20 | 0.3446 | 82.57% | 117 |
| 5 | 1' | EM 240 BD | 0.05 | 20 | 0.3612 | 80.97% | 73 |
| 6 | 3' | EM 2408 D | 0.05 | 20 | 0.3663 | 86.40% | 44 |
| 7 | 7'30" | EM 240 BD | 0.05 | 20 | 0.3472 | 87.20% | 11 |
| 8 | | EM 240 BD | 0.1 | 20 | 0.372 | 85.95% | 135 |
| 9 | | EM 240 CT | 0.1 | 20 | 0.342 | 81.58% | 151 |
| 10 | 0 | SD240 BD | 0.05 | 20 | 0.2567 | 63.59 | 950 |
| 11 | 30 s | SD240 BD | 0.05 | 20 | 0.35 | 84.09 | 112 |

Note: The product SD 240 BD is the product EM 240 BD with the exception that it is prepared by a precipitate in a solvent following drying and grinding; one obtains a white powder that one places back into a solution, shearing, and then using it like the emulsion EM 240 BD.

TABLE N° 2

EXAMPLE 2: EM 140 BD

Type of pulp 70% KF, 10% KR, 20% PM, 20% GCC.

CSF 399 ml

Consistency (before dilution) 1.5%

Rotational speed 800 pH pulp 7.5

G80

| Trial | Shearing t = | RET 1 = 10 s | % | ChM (%) | TUR X | TUR R1 | TUR R2 | MES X | mg/l R2 | Pds X | Feuille R2 | % retent. X | % retent. R2 | State of Formation |
|---|---|---|---|---|---|---|---|---|---|---|---|---|---|---|
| 1 | | — | — | 20 | >4000 | 3542 | 3346 | 811.1 | 1542 | 2.1084 | 2.2924 | 82.28% | 72.64% | 1 |
| 2 | | EM 140 CT | 0.05 | 20 | 450 | 460 | 490 | 245.2 | 253.8 | 2.467 | 2.5696 | 94.73% | 94.76% | 4 |
| 3 | UX 30 s | EM 140 CT | 0.05 | 20 | 484 | 504 | 526 | 258.4 | 263.8 | 2.4684 | 2.6157 | 94.46% | 94.65% | 3 |
| 4 | | 448B | 0.05 | 20 | >4000 | 4115 | 3736 | 535.6 | 1066.1 | 2.2191 | 2.3484 | 88.09% | 79.73% | 2 |
| 5 | UX 30 s | 448B | 0.05 | 20 | 348 | 400 | 420 | 215.4 | 223.4 | 2.4643 | 2.5779 | 96.33% | 95.37% | 1 |
| 6 | | 448A | 0.05 | 20 | 3245 | >4000 | >4000 | 368.8 | 613.6 | 2.327 | 2.4478 | 91.85% | 87.69% | 2 |
| 7 | UX 30 s | 448A | 0.05 | 20 | 699 | 963 | 985 | 242.3 | 286.1 | 2.3864 | 2.506 | 94.62% | 93.99% | 1 |
| 8 | | 448C | 0.05 | 20 | >4000 | 3921 | 3590 | 586.7 | 1178.4 | 2.1818 | 2.3132 | 86.91% | 77.80% | 2 |
| 9 | UX 30 s | 448C | 0.05 | 20 | 1270 | 2216 | 2514 | 313.8 | 406.3 | 2.3949 | 2.5412 | 83.16% | 91.78% | 1 |
| 10 | — | SD 448 B | 0.05 | 20 | >4000 | >4050 | >3050 | 545.8 | 1100 | 2.2292 | 2.5212 | 86.28 | 75.56 | 2 |
| 11 | UX 30 s | SD 448 B | 0.05 | 20 | 345 | 400 | 415 | 219.7 | 228 | 2.4545 | 2.6001 | 94.9 | 95.0 | 1 |

Note: The product SD 448 BD is the product 448 B with the exception that it is prepared by a precipitate in a solvent following drying and grinding; one obtains a white powder that one places back into a solution, shearing, and then using it like the emulsion 448.

EXAMPLE 3: EM 140 BD

Type of pulp 70% KF, 10% KR, 20% PM, 20% GCC.

CSF 399 ml

Consistency (before dilution) 1.5%

Rotational speed 800 pH pulp 7.5

G80

| Trial | Shearing | RET | % | ChM (%) | Ash X | (g) R2 | Ash X | Ctn % R2 | Turb 30° X | Turb 30° R2 | CSF |
|---|---|---|---|---|---|---|---|---|---|---|---|
| 1 | | — | — | 20 | 0.0441 | 0.091 | 10.68% | 20.67% | >4000 | 3612 | 399 |
| 2 | | EM 140 CT | 0.05 | 20 | 0.3642 | 0.4012 | 86.60% | 92.61% | 62 | 58 | 458 |
| 3 | UX 30s | EM 140 CT | 0.05 | 20 | 0.3743 | 0.4186 | 89.37% | 95.26% | 33 | 29 | 435 |
| 4 | | 448B | 0.05 | 20 | 0.1501 | 0.2105 | 36.27% | 49.23% | 3290 | >4000 | 491 |
| 5 | UX 30 s | 448B | 0.05 | 20 | 0.3713 | 0.4185 | 88.70% | 96.90% | 31 | 21 | 477 |
| 6 | | 448A | 0.05 | 20 | 0.2577 | 0.329 | 62.27% | 77.64% | 914 | 2508 | 474 |
| 7 | UX 30 s | 448A | 0.05 | 20 | 0.3383 | 0.4092 | 82.59% | 97.58% | 69 | 70 | 469 |
| 8 | | 448C | 0.05 | 20 | 0.1223 | 0.176 | 29.69% | 41.18% | 2345 | 4378 | 466 |
| 9 | UX 30 s | 448C | 0.05 | 20 | 0.3057 | 0.3845 | 73.16% | 89.14% | 93 | 113 | 459 |
| 10 | — | SD 448 B | 0.05 | 20 | 0.1550 | 0.215 | 37.6% | 46.61% | 3320 | >4000 | 480 |
| 11 | UX 30 s | SD 448 B | 0.05 | 20 | 0.375 | 0.42 | 90.16% | 96.32% | 30 | 22 | 475 |

Scale of formation:

1 Excellent (homogenous)

2 Good (melted)

3 Mediocre (cloudy)

4 Poor (fluffy)

5 Very poor (marbled)

TABLE N° 3

EXAMPLE 3: 140 BD
Type of pulp 70% KF, 10% KR, 20% PM, 20% GCC.
CSF 399 ml
Consistency (before dilution) 1.5%
Rotational speed 800
pH pulp 7.5
G80

| Trial | Shearing t = | RET 1 = 10 s | % | ChM (%) | TUR X | TUR R1 | TUR R2 | MES X | mg/l R2 | Pds X | Feuille R2 | % retent. X | % retent. R2 | State of Formation |
|---|---|---|---|---|---|---|---|---|---|---|---|---|---|---|
| 1 | — | — | — | 20 | >4000 | 3542 | 3346 | 811.1 | 1542 | 2.1084 | 2.2924 | 82.28% | 72.64% | 1 |
| 2 | | 140 CT | 0.1 | 20 | 198 | 211 | 218 | 137.1 | 203.4 | 2.4648 | 2.5619 | 96.98% | 95.74% | 5 |
| 3 | UX 30 s | 140 CT | 0.1 | 20 | 247 | 264 | 271 | 200.7 | 210.5 | 2.4766 | 2.5313 | 95.66% | 95.55% | 4 |
| 4 | | 448A | 0.1 | 20 | 294 | 466 | 449 | 124 | 135 | 2.464 | 2.5874 | 97.26% | 97.16% | 2 |
| 5 | UX 30 s | 448A | 0.1 | 20 | 134 | 150 | 149 | 110.1 | 128.4 | 2.4924 | 2.5664 | 97.59% | 97.27% | 1 |
| 6 | | 448B | 0.1 | 20 | 2142 | 4079 | 4241 | 299.8 | 410.8 | 2.3718 | 2.604 | 93.39% | 91.88% | 2 |
| 7 | UX 30 s | 448B | 0.1 | 20 | 152 | 199 | 210 | 125.4 | 152.4 | 2.4528 | 2.5492 | 97.22% | 96.76% | 1 |
| 8 | | 448C | 0.1 | 20 | 4113 | >4000 | >4000 | 387.7 | 645.4 | 2.3166 | 2.4031 | 91.43% | 86.93% | 2 |
| 9 | UX 30 s | 448C | 0.1 | 20 | 225 | 285 | 332 | 187.3 | 218.6 | 2.4316 | 2.5612 | 95.86% | 95.44% | 1 |

| Trial | Shearing | RET | % | ChM (%) | Ash X | (g) R2 | Ash X | Ctn % R2 | Turb 30° X | Turb 30° R2 | CSF |
|---|---|---|---|---|---|---|---|---|---|---|---|
| 1 | | — | — | 20 | 0.0441 | 0.091 | 10.68% | 20.67% | >4000 | 3612 | 399 |
| 2 | | 140 CT | 0.1 | 20 | 0.3942 | 0.4201 | 95.19% | 98.07% | 11 | 11 | 506 |
| 3 | UX 30 s | 140 CT | 0.1 | 20 | 0.3896 | 0.415 | 93.34% | 98.05% | 15 | 12 | 491 |
| 4 | | 448A | 0.1 | 20 | 0.3691 | 0.4212 | 88.09% | 97.22% | 119 | 143 | 583 |
| 5 | UX 30s | 44BA | 0.1 | 20 | 0.4105 | 0.4277 | 95.59% | 99.99% | 8 | 8 | 558 |
| 6 | | 448B | 0.1 | 20 | 0.2812 | 0.3834 | 67.25% | 86.33% | 160 | 137 | 522 |
| 7 | UX 30s | 448B | 0.1 | 20 | 0.3958 | 0.4211 | 96.21% | 98.94% | 12 | 11 | 517 |
| 8 | | 448C | 0.1 | 20 | 0.2345 | 0.3346 | 56.31% | 80.88% | 164 | 211 | 498 |
| 9 | UX 30 s | 448C | 0.1 | 20 | 0.3718 | 0.42 | 90.25% | 98.06% | 8 | 7 | 516 |

Scale of formation:
1 Excellent (homogenous)
2 Good (melted)
3 Mediocre (cloudy)
4 Poor (fluffy)
5 Very poor (marbled)

What is claimed is:

1. In a paper making process for manufacturing a fibrous sheet of paper or paperboard from an aqueous suspension or a fibrous mass of pulp by flocculating said pulp with at least one water soluble cross-linked polymeric retention agent, wherein the improvement comprises using as a retention agent an effective amount of a cross-linked polymer or copolymer formed from suitable water-soluble monomers or mixtures of such monomers and wherein the cross-linked polymer is sheared at a concentration on the order of 3–5 to 10–15 g of the polymer/liter to increase the initial intrinsic viscosity of the polymer from 1–3 to 3–8 before introduction or injection of the sheared polymer into the suspension or fibrous mass to be flocculated to distinctly improve the retention, formation, drainage, and other properties of the paper or paperboard sheet thus obtained in the process.

2. The process of claim 1 wherein the monomers are monomers with monoethylenic unsaturation, allylic monomers, or vinyl monomers.

3. The process of claim 1 wherein the monomers are acrylic or methacrylic monomers.

4. The process of claim 1 wherein the monomers are nonionic monomers comprising acrylamide, methacrylamide, N-vinyl methyl acetamide, formamide, vinyl acetate, vinylpyrrolidone, methyl methacrylate, or methacrylates of other acrylic esters, or of other esters with ethylenic unsaturation, or of other vinyl monomers that are insoluble in water such as styrene or acrylonitrile; and/or anionic monomers comprising sodium acrylate, sodium methacrylate, sodium itaconate, 2-acrylamido-2-methylpropane sulfonate (AMPS), sulfopropylacrylates or sulfopropylmethacrylates, or other water-soluble forms of these polymerizable sulfonic or carboxylic acids, a sodium vinylsulfonate, an allylsulfonate, or a sulfomethyl acrylamide: and/or cationic monomers comprising the dialkylaminoalkyl acrylates and methacrylates, as well as acid salts thereof, or quaternized salts thereof; and wherein in the above definitions, the alkyl groups are $C_1$–$C_4$ alkyl groups.

5. The process of claim 1 wherein the monomers are dialkylaminoalkylalkylacrylamides or -methacrylamides, as well as their acidified or quaternized salts, and Mannich products such as the quaternized dialkylaminomethylacrylamides, in which the alkyl groups are $C_1$–$C_4$ alkyl groups, and/or in that the monomers can contain hydrophobic groups, and/or in that the polymer is prepared from acrylamide monomers and ethyl acrylate trimethyl ammonium chloride, and is cross-linked by methylenebisacrylamide.

6. The process of claim 1 wherein the cross-linking of the polymer is carried out during or after the polymerization by reaction of two soluble polymers having counter ions, or by reaction on formaldehyde or a polyvalent metal compound, or with cross-linking agents which are polyvalent metal salts, formaldehyde, glyoxal, or covalent cross-linking agents which will copolymerize with the monomers,.

7. The process of claim 1 wherein the polymers are prepared by a reverse phase (water-in-oil) emulsion polymerization method.

8. The process of claim 1, wherein the cross-linked and sheared polymer according to the invention is injected or introduced into a diluted paper pulp or fibrous mass to be flocculated diluted to about 0.7%–5% solid matter which includes cellulose fibers, fillers, and various additives commonly used in paper manufacturing.

9. The process of claim 1, wherein some of the cross-linked and sheared polymer is introduced at the level of the stage for preparing a thick stock with 5% or more.

10. The process of claim 1, wherein the shearing of the polymers is carried out for a duration that lasts between 15–30 seconds and 2–5 minutes.

11. The process of claim 1, wherein the shearing of the polymers is carried out with a concentration between 5 to 10 g of the polymer/liter.

12. The process of claim 1 wherein the retention agent is added in an amount which results in about 100 to 500 grams active material (polymer) per ton of fibrous matter to be processed; or approximately 1000 g/t without shearing.

13. The process of claim 1 wherein the retention agent is added in an amount which results in about 1000 grams active polymer material per ton of fibrous matter to be processed without shearing.

14. The process of claim 1 wherein an ion regain IR of 40 to 50% is obtained, which can reach at least 60 or 70% up to values greater than 100, with:

| Ion regain IR = (X–Y)/Y × 100 | | |
|---|---|---|
| with X | : | ionicity after shearing in meq/g. |
| Y | : | ionicity before shearing in meq/g. |

15. The process of claim 1, wherein the polymer is used in the form of a reverse phase water-in-oil emulsion of the cross-linked polymer, or a solution of the polymer obtained by redissolution in water of a powder of the cross-linked polymer obtained by means of a drying of the emulsion by "spray drying," or by solvent precipitation, or agglomeration and grinding.

16. The process of claim 1, according to which the fibrous mass of pulp is flocculated by at least one polymer retention agent which comprises:

a cross-linked polymer or copolymer formed from suitable water-soluble monomers or mixtures of such monomers, in the form of a reverse phase water-in-oil emulsion of the cross-linked polymer, or a solution of the polymer obtained by redissolution in water of a powder of the cross-linked polymer obtained by means of a drying of the emulsion by "spray drying," or by solvent precipitation, or agglomeration and grinding, which is sheared before introduction or injection into the suspension of fibrous mass to be flocculated.

17. The process according to claim 16 wherein the monomers are nonionic monomers comprising acrylamide, methacrylamide, N-vinyl methyl acetamide, formamide, vinyl acetate, vinylpyrrolidone, methyl methacrylate, or methacrylates of other acrylic esters, or of other esters with ethylenic unsaturation, or of other vinyl monomers that are insoluble in water such as styrene or acrylonitrile; and/or anionic monomers comprising sodium acrylate, sodium methacrylate, sodium itaconate, 2-acrylamido-2-methylpropane sulfonate (AMPS), sulfopropylacrylates or sulfopropylmethacrylates, or other water-soluble forms of these polymerizable sulfonic or carboxylic acids, a sodium vinylsulfonate, an allylsulfonate, or a sulfomethyl acrylamide: and/or cationic monomers comprising the dialkylaminoalkyl acrylates and methacrylates, as well as acid salts thereof, or quaternized salts thereof; and wherein in the above definitions, the alkyl groups are $C_1$–$C_4$ alkyl groups; are used to prepare said (co)polymer.

18. A sheet of paper or paperboard which is produced by the process according to claim 1.

19. The process of claim 6 wherein the monomers are diacrylates of polyethylene glycol PEG) or polyethylenic unsaturation and the quantity of cross-linking agents incorporated is from 5 to 100 ppm agent/active material (polymer).

* * * * *